United States Patent [19]

Kondo et al.

[11] Patent Number: 4,814,009

[45] Date of Patent: Mar. 21, 1989

[54] ELECTROLESS COPPER PLATING SOLUTION

[75] Inventors: Koji Kondo, Chiryu; Katuhiko Murakawa, Obu; Kaoru Nomoto, Okazaki; Futoshi Ishikawa, Nagoya; Nobumasa Ishida, Chiryu; Junji Ishikawa, Nagoya, all of Japan

[73] Assignee: Nippondenso Co., Ltd., Kariya, Japan

[21] Appl. No.: 119,861

[22] Filed: Nov. 13, 1987

[30] Foreign Application Priority Data

Nov. 14, 1986 [JP] Japan ..... 61-269806
Oct. 21, 1987 [JP] Japan ..... 62-264016

[51] Int. Cl.[4] ..... C23C 18/40; B05D 1/18

[52] U.S. Cl. ..... 106/1.23; 106/1.05; 106/1.18; 106/1.26; 427/437; 427/305; 427/98; 204/52.1

[58] Field of Search ..... 106/1.05, 1.18, 1.22, 106/1.23, 1.25, 1.26; 427/437, 305, 98; 204/52.1

[56] References Cited

U.S. PATENT DOCUMENTS 4,204,013 5/1980 Arcilesi et al. ..... 106/1.11
4,228,213 10/1980 Backenbaugh et al. ..... 106/1.18
4,301,196 11/1981 McCormack et al. ..... 106/1.23
4,303,443 12/1981 Miyazawa et al. ..... 106/1.23

FOREIGN PATENT DOCUMENTS 21757 3/1984 European Pat. Off. .
164580 12/1985 European Pat. Off. .
56-272 1/1981 Japan .
56-271 1/1981 Japan .
57-9865 1/1982 Japan .
59-25965 2/1984 Japan .
60-159173 8/1985 Japan .
60-245783 12/1985 Japan .
55-65355 5/1980 Jordan .

OTHER PUBLICATIONS

Abstract of Japanese Unexamined Patent Publication (Kokai) Nos. 56-271, 56-272, and 57-9865.
Ser. No. 573,626, Jan. 25, 1984.
Ser. No. 68,366, Jul. 1, 1987, Koji Kondo et al.

*Primary Examiner*—Paul Lieberman
*Assistant Examiner*—Helene Kirschner
*Attorney, Agent, or Firm*—Cushman, Darby & Cushman

[57] ABSTRACT

A practically fast electroless copper plating solution is provided by adding a specific monoamine as an accelerator. The accelerator should be a tertiary monoamine and cannot be a diamine, does not have a complexing ability for copper ion, and does not contain a ketone or carboxyl group or an unsaturated group. Specific examples of such monoamines include triethylamine, tripropylamine, tribenzylamine, N-methyl-piperidine, and tris (4-bromophenyl) amine, N-methylmorpholine.

14 Claims, 1 Drawing Sheet

COPPER DEPOSITION RATE IN RELATION TO AMOUNT OF ADDED ACCELARATOR.

COPPER DEPOSITION RATE IN RELATION TO AMOUNT OF ADDED ACCELARATOR.

ELECTROLESS COPPER PLATING SOLUTION

BACKGROUND OF THE INVENTION

1. Field of the Invention

The present invention relates to an electroless copper plating solution, more specifically to a copper plating solution used for forming a general copper plating layer including a circuit of a printed board and a conductor of a ceramic thick film substrate.

2. Description of the Related Art

An electroless copper plating solution comprising copper sulfate ($CuSO_4$) as a copper salt, ethylenediaminetetraacetic acid (EDTA) as a complexing agent for copper ion, and formaldehyde (HCHO) as a reducing agent, etc., is known. In another known electroless copper solution, copper chloride ($CuCl_2$) is used as a copper salt and Rochelle salt (potassium sodium tartrate) or Quadrol (trade name of N,N,N',N'-tetrakis(2-hydroxypropyl)ethylenediamine) is used as a complexing agent for copper ion. These plating solutions, however, have many drawbacks, including inferior plating layer properties and a very low deposition rate and, thus electroless plating is rarely used for forming a copper plating layer in practice.

Recently, a demand has arisen for a fast electroless copper plating process, to reduce the costs of printed boards, and electroless copper plating baths using an accelerator, baths containing an activator for a reducing agent, etc., have been proposed.

For example, Japanese Unexamined Patent Publication (Kokai) No. 55-65355, published on May 16, 1980, discloses an accelerator having a non-localized $\pi$-bond selected from the group of a complex cyclic aromatic nitrogen compound and a sulphur compound, a non-aromatic nitrogen compound having at least one non-localized $\pi$-bond, an aromatic amine, and a mixture thereof. An accelerator is also disclosed in Japanese Unexamined Patent Publication (Kokai) No. 59-25965, published on Feb. 10, 1984, which comprises 2-mercaptobenzothiazole and imidazole, 4-hydroxypyridine or a mixture thereof. As additives which contribute to an acceleration of the deposition, Japanese Unexamined Patent Publication (Kokai) No. 60-245783, published on Dec. 5, 1985 corresponding to EP 164580 published on Dec. 18, 1985, teaches a cationic polymer containing one or both of acrylic acid and methacrylic acid, and Japanese Unexamined Patent Publications (Kokai) No. 56-271, published on Jan. 6, 1981 corresponding to U.S. Pat. No. 4,303,443 published on Dec. 1, 1981 and No. 57-9865, published on Jan. 19, 1982, teach an ionic surfactant based on polyoxyalkyleneamine. Further, Japanese Unexamined Patent Publications (Kokai) No. 56-272, published on Jan. 6, 1981 corresponding to EP 21757 and No. 60-159173, published on Aug. 20, 1985 corresponding to U.S. patent application Ser. No. 573626, filed on Jan. 25, 1984, disclose a complexing agent for copper ion which contributes to an acceleration of the deposition rate.

However, all of the above proposed plating solutions are unsatisfactory in practice, and therefore, are not used commercially.

SUMMARY OF THE INVENTION

To meet the demand mentioned above, the present invention provides an electroless copper plating solution comprising a copper salt, a complexing agent for copper ion, a reducing agent, a pH adjustor, and an accelerator, which is a monoamine represented by the formula $N(-R^1-R^2)_3$, wherein $(-R^1-R^2)$ is an organic group, $R^1$ is independently an alkylene or phenylene group or a halogen- or hydroxy-substituted derivative thereof; $R^2$ is independently a hydrogen atom, a halogen atom, a hydroxy group, a phenyl group, a saturated hydrocarbon group which may contain an oxygen atom or a phenylene group in the skeleton thereof, or a halogen-, hydroxy- or phenyl-substituted derivative of the saturated hydrocarbon; at least one $(-R^1-R^2)$ having no hydroxy group; and two or three $(-R^1-R^2)$ may form a cyclic structure with said N of the formula.

The copper salt used in the present invention is not particularly limited as long as it is able to provide copper ion, and includes copper sulfate ($CuSO_4$), copper chloride ($CuCl_2$), copper nitrate ($Cu(NO_3)_2$), copper hydroxide ($Cu(OH)_2$), copper oxide (CuO), copper (I) oxide (CuO), etc.

The complexing agent for copper ion is not particularly limited as long as it is able to complex copper ion, and includes ethylenediaminetetraacetic acid (EDTA), N,N,N',N'-tetrakis(2-hydroxypropyl)ethylenediamine (Quadrol), Rochelle salt, triethanolamine, etc.

The reducing agent is not particularly limited as long as it reduces copper ion, and includes formaldehyde (HCHO), paraformaldehyde, sodium hypophosphite, hydrazine, sodium boron hydride, etc.

The pH adjustor is not particularly limited as long as it is able to alter the pH of the solution, and includes NaOH, KOH, HCl, $H_2SO_4$, HF, etc.

Various additives, such as a stabilizer for stabilizing a bath or an additive for improving the properties of the resulting plating layer, may be included in the plating solution. Such additives are not particularly limited and do not alter the effect produced by the addition of the above monoamine of the present invention.

The present invention is characterized by adding a specified amine to an electroless copper plating layer to increase the rate of deposition of copper. Among known amines, several are able to complex copper ion, but the amines used as an accelerator in the present invention do not have the ability to complex copper ion, or even if possessing this ability, it is not sufficient to completely complex the copper ion, and thus another complexing agent for copper ion must be included in the electroless copper plating solution of the present invention. The amount added of the complexing agent for copper ion is generally 0.8 or more times, preferably from 0.8 to 1.5 times, the mole concentration of the copper ion in the plating solution. Therefore, in the electroless copper solution of the present invention, assuming that copper ion is sufficiently complexed by a complexing agent added separately, an addition of the specified amine to such a plating solution well realize an increase in the rate of deposition of copper.

The amine used in the present invention is an amine represented by the previously-stated formula, and is believed to increase the rate of deposition of copper because of the strong Lewis basicity or electron donativity of such an amine. A primary or secondary amine is not suitable because of the inevitable reaction thereof with the formaldehyde of a reducing agent. An amine having three organic groups bonded to the nitrogen, all of which organic groups comprise an alcoxyl group, has the ability to complex copper ion, and thus is excluded from the present invention. If an organic group bonded to nitrogen includes a ketone or carboxyl group, or if nitrogen constitutes a part of an aromatic cycle, such amines do not effect an acceleration of the deposition rate. The molecular weight of an organic group of an amine used in the present invention is not particularly limited in relation to the effect of contributing to an acceleration of the deposition rate. Nevertheless, if the molecular weight of an amine is increased, the solubility of the amine in water is reduced, and thus it is preferable in practice to use an amine having a molecular weight giving a desired solubility.

Among the amines represented by the above formula, easily available, and thus preferable examples of those amines, are amines in which the organic group $-(R^1-R^2)$ is an alkyl group, for example, trimethylamine, triethylamine, tripropylamine, tributylamine, dimethylethylamine, diethylmethylamine, diethylpropylamine, dipropylethylamine, trihexylamine, etc.; amines in which the organic group is a phenyl group or a derivative thereof, for example, tris(4-bromophenyl)amine, tribenzylamine, etc.; amines in which the organic group comprises alkylene and phenyl groups, for example, N-ethyldibenzylamine, etc.; amines in which the organic groups include a combination of an alkyl group and an alcoxyl group, for example, ethyldiethanolamine, diethylaminoethanol, etc.; and amines containing nitrogen which constitutes a part of a saturated cycloaliphatic hydrocarbon, for example, N-methylpiperidine, N-methylmorpholine, N-ethylpiperidine, N-ethylmorpholine, etc. Particularly preferable amines are triethylamine, tripropylamine, tribenzylamine, N-methylpiperidine, and diethylaminoethanol.

Preferably, the amount of the amine to be added is from about 0.001M to a maximum concentration at which the amine can be solved and the degree of the effect of increasing the rate of deposition of copper are not noticeably changed by the amount of the added amine. An excess amount of the amine does not cause any particular problems other than those of economy.

Preferably, the pH of the plating bath is from 11.5 to 13.0, more preferably 12.0 to 12.8. A lower pH reduces the deposition rate and a higher pH reduces the stability of the bath.

Preferably the temperature of the plating bath is from 30° C. to 80° C., more preferably 50° C. to 70° C. A higher temperature makes the bath unstable and a lower temperature reduces the deposition rate and lowers the quality of the copper plating layer.

Preferably, the concentration of copper ion in the bath is from 0.02M to 0.07M, more preferably from 0.03M to 0.06M.

The concentration of a reducing agent is preferably from 0.02M to 0.5M, but this depends on the reducing agent used. In the case of formaldehyde, for example, a concentration of from 0.03M to 0.2M is preferable. The concentration of the reducing agent, however, should be accurately determined by taking into consideration other conditions of the bath.

The electroless copper plating solution of the present invention greatly increases the rate of deposition of copper, thus raising the productivity rate and reducing costs. Accordingly, a practical usage of an electroless copper plating of, for example, printed boards, becomes possible.

DESCRIPTION OF THE PREFERRED EMBODIMENTS

Figure 1:
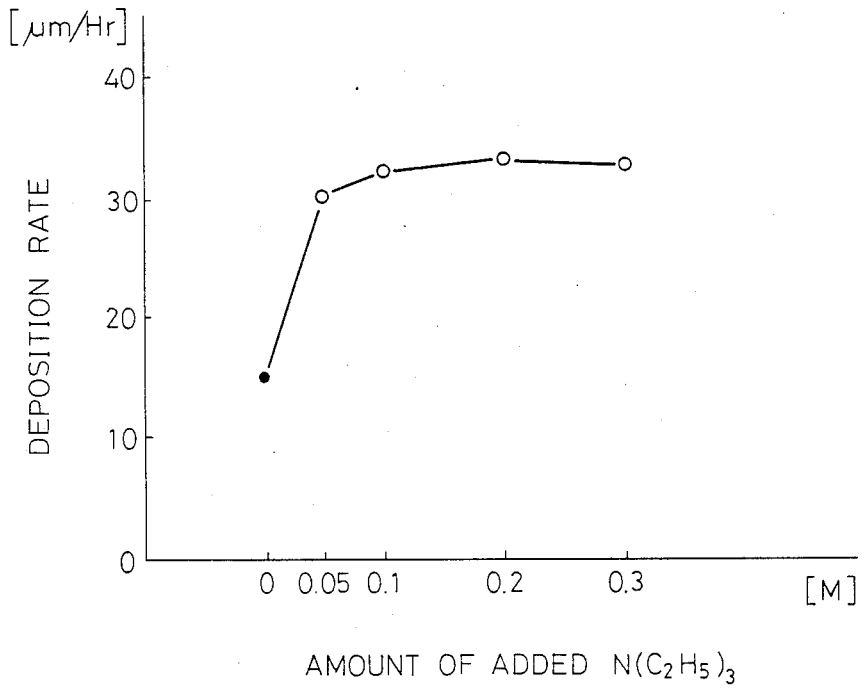
FIG. 1 shows a relationship between the rate of deposition of copper and the amount of an accelerator used in the following Example.

The effects of an electroless copper plating solution of the present invention were examined while varying the conditions of plating bath. These experiments were conducted according to the following basic procedure.

A 3 cm×7 cm stainless steel plate having an area of about 40 $cm^2$ was cleaned and then treated with a Pd catalyzing solution, for example, Catpo-44-C sold by Shipley Co. The plate was then washed with water and activated by an accelerator ACC-19-C, sold by Shipley Co. The pretreated stainless steel plate was then plated in an EDTA bath, shown in Table 1, for 2 minutes to form a copper layer 0.1 to 0.2 μm thick. After washing with water, the plate was plated in 500 cc of a plating solution to be tested for 10 minutes, and the thickness of the deposited copper layer was measured with an electrolysis-type layer thickness meter and the result converted to a deposition rate per hour. The plating load was 80 $cm^2/1$, and NaOH was used as the pH-adjustor. The plating bath was constantly stirred by blowing air therein and mechanical stirring was not used at any stage.

TABLE 1

| | |
|---|---|
| Copper salt: $CuCl_2$ | 0.06 M |
| Complexing agent for copper ion: EDTA* | 0.08 M |
| Reducing agent: formalin** | 18 ml/l |
| pH at 25° C. | 12.5 |
| Bath temperature | 50° C. |
| Examples 1 to 8 | |
| Copper salt: $CuCl_2$ | 0.06 M |
| Complexing agent for copper ion: Quadrol | 0.08 M |
| Reducing agent: formalin | 18 ml/l |
| Accelertor | |
| pH at 25° C. | 12.55 |
| Bath temperature | 55° C. |

*EDTA: ethylenediaminetetraacetic acid
**Formaline is a 37% aqueous solution of formaldehyde The above plating bath having a plating solution to be tested was used for the above plating tests, and the rate of deposition of copper was measured. The kinds of accelerator added to the plating solution to be tested, and the results of the tests or the deposition rates, are shown in Table 2.

TABLE 2

| | Example | | | |
|---|---|---|---|---|
| | 1 | 2 | 3 | 4 |
| Accelerator | Triethylamine $N(C_2H_5)_3$ | Tripropylamine $N(C_3H_7)_3$ | Tris(4-bromophenyl) amine 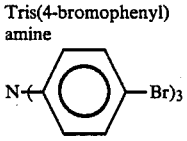 | Tribenzylamine 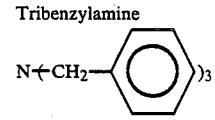 |

TABLE 2-continued

| | | | | |
|---|---|---|---|---|
| Amount of accelerator | 0.1 M | 0.1 M | 0.01 M | 0.06 M |
| Deposition rate | 32 μm/Hr | 35 μm/Hr | 27 μm/Hr | 30 μm/Hr |
| | Example | | | |
| | 5 | 6 | 7 | 8 |
| Accelerator | N—methyl-piperidine 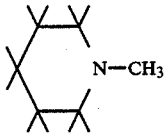 | N—methyl-morpholine 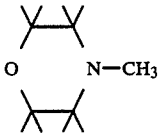 | Diethylamino-ethanol $(C_2H_5)_2$ \| $N—C_2H_4OH$ | Ethyldiethanol-amine $C_2H_5$ \| $N\leftarrow C_2H_4OH)_2$ |
| Amount of accelerator | 0.06 M | 0.06 M | 0.04 M | 0.04 M |
| Deposition rate | 25 μm/Hr | 25 μm/Hr | 28 μm/Hr | 22 μm/Hr |

Copper salt: $CuCl_2$ 0.06 M, Complexing agent: Quadrol 0.08 M, Reducing agent: formalin 18 ml/l, pH: 12.55 (25° C.), Temperature: 55° C.

EXAMPLES 9 TO 17 (COMPARATIVE)

Plating tests as in Examples 1 to 8 were conducted with plating solutions to be tested, wherein one plating solution had no additive as an accelerator (Example 9), and the other solutions had various additives added thereto (Examples 10 to 17).

The kinds and amount of the additives added and the results of the tests are shown in Table 3. From Table 3, it is seen that an amine the nitrogen of which constitutes an aromatic cycle (Example 10), an amine in which hydrogen is bonded to the nitrogen (Example 11), amines having an unsaturated aliphatic group (Examples 12 and 13), an amine having a ketone group (Example 15) and diamines (Examples 16 and 17) do not provide an acceleration of the rate of deposition of copper.

TABLE 3

(Comparative)

| | | | | | |
|---|---|---|---|---|---|
| | Example | | | | |
| | 9 | 10 | 11 | 12 | 13 |
| Additive | none | Pyridine 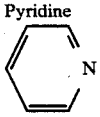 | Piperidine 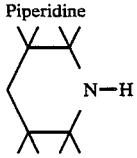 | Triallylamine $N\leftarrow CH_2—CH=CH_2)_3$ | Tripropagyl-amine $N\leftarrow CH_2—C\equiv CH)_3$ |
| Amount of additive | — | 0.06 M | 0.06 M | 0.04 M | 0.04 M |
| Deposition rate | 15 μm/Hr | 2 μm/Hr | 3 μm/Hr | 14 μm/Hr | 1 μm/Hr |

| | | | | | |
|---|---|---|---|---|---|
| | Example | | | | |
| | 14 | 15 | 16 | 17 |
| Additive | Triethyl-nitrotri-carboxylate $N\leftarrow C(=O)—OC_2H_5)_3$ | 1-diethyl-amino-3-butanon $(C_2H_5)_2$ \| $N—C_2H_4—C(=O)—CH_3$ | Tetramethyl-diamino-methane $N\leftarrow CH_3)_2$ \| $CH_2$ \| $N\leftarrow CH_3)_2$ | Tetraethyl-ethylene-diamine $N\leftarrow C_2H_5)_2$ \| $(CH_2)_2$ \| $N\leftarrow C_2H_5)_2$ |
| Amount of additive | 0.04 M | 0.04 M | 0.01 M | 0.01 M |
| Deposition rate | 1 μm/Hr | 1 μm/Hr | 4 μm/Hr | 8 μm/Hr |

Copper salt: $CuCl_2$ 0.06 M, Complexing agent: Quadrol 0.08 M, Reducing agent: formalin 18 ml/l, pH: 12.55 (25° C.), Temperature: 55° C.

EXAMPLES 18 TO 20

The same tests as in the former Examples were conducted except that ethylenediaminetetraacetic acid (EDTA) was substituted for N,N,N',N'-tetrakis(2-hydroxypropyl)ethylenediamine (Quadrol). The results are shown in Table 4.

TABLE 4

| | Example | | |
|---|---|---|---|
| | 18 | 19 | 20 |
| Complexing agent | EDTA 0.08 M | EDTA 0.08 M | EDTA 0.08 M |
| Accelerator | Triethylamine 0.1 M | Diethyl-ethanolamine 0.04 M | — |
| Deposition rate | 13 μm/Hr | 12 μm/Hr | 5 μm/Hr |

Copper salt: $CuCl_2$ 0.06M, Reducing agent: formalin 18 ml/l, pH: 12.55 at 25° C., Temperature: 55° C.

From Table 3, it is seen that, when EDTA is used as a complexing agent, the copper deposition rate is reduced but the acceleration of the copper deposition rate by the addition of an amine according to the present invention is not changed, in comparison with the case where such an amine is not added.

EXAMPLES 21 TO 25

Using triethylamine as the accelerator, the effect on the deposition rate of the amount of added accelerator was determined. The results are shown in Table 5 and FIG. 1.

TABLE 5

| | Example | | | | |
|---|---|---|---|---|---|
| | 21 | 22 | 23 | 24 | 25 |
| Accelerator | none | | Triethylamine | | |
| Amount of accelerator | — | 0.05 M | 0.1 M | 0.2 M | 0.3 M |
| Deposition rate | 15 μm/Hr | 30 μm/Hr | 32 μm/Hr | 33 μm/Hr | 33 μm/Hr |

As seen in Table 5 and FIG. 1, the copper deposition rate is little changed when an amount of triethylamine of over 0.1M is added. The reason is considered that even if the amount of added triethylamine is increased, the excess triethylamine is dispersed and is not solved and, therefore, the amount of the solved or effective triethylamine is not increased. It was made clear that no particular disadvantage arises when an excessive amount of triethylamine is added.

EXAMPLE 26

In the same procedure as in Example 23, copper sulfate $CuSO_4$ was used instead of copper chloride $CuCl_2$ (0.06M of $CuSO_4$ was added). The rate of deposition of copper was 30 μm/Hr, which shows that the acceleration effect is not altered by changing the kind of copper salts.

We claim:

1. An electroless copper plating solution comprising a copper salt, a complexing agent for copper ion, a reducing agent, a pH-adjustor and an accelerator of a monoamine having the following general formula:

$$N\text{-}(R^1\text{—}R^2)_3$$

where $(R^1\text{—}R^2)$ is an organic group, $R^1$ is independently an alkylene or phenylene group or a halogen-substituted derivative thereof, $R^2$ is independently a hydrogen atom, a halogen atom, a phenyl group, a saturated hydrocarbon group which may contain an oxygen atom or a phenylene group in the skeleton thereof, or a halogen- or phenyl-substituted derivative of said saturated hydrocarbon group, and two or three $\text{—}R^1\text{—}R^2$) may constitute a cyclic structure with said N in the formula.

2. A solution according to claim 1, wherein said organic group is an alkyl group.

3. A solution according to claim 2, wherein the monoamine is one selected from the group consisting of trimethylamine, triethylamine, tripropylamine, tributylamine, dimethylethylamine, diethylmethylamine, diethylpropylamine, dipropylethylamine, trihexylamine, and a mixture thereof.

4. A solution according to claim 1, wherein said organic group is a phenyl group or a derivative thereof.

5. A solution according to claim 4, wherein said monoamine is tris(4-bromophenyl)amine.

6. A solution according to claim 1, wherein said organic group comprise alkylene and phenylene groups.

7. A solution according to claim 6, wherein said monoamine is N-ethyldibenzylamine.

8. A solution according to claim 1, wherein said monoamine is represented by the following formula:

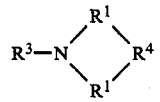

where $R^3$ is an alkyl or alcohol group, $R^1$ is an alkylene group, and $R^4$ is an alkylene group which may contain oxygen in the skeleton thereof.

9. A solution according to claim 10, wherein said monoamine is N-methylpiperidine, N-methylmorpholine, N-ethylpiperidine or N-ethylmorpholine.

10. A solution according to claim 1, wherein said monoamine is triethylamine, tripropylamine, tribenzylamine, N-methylpiperidine, or a mixture thereof.

11. A chemical copper plating solution, comprising:

a copper salt in an amount of 0.02M to 0.07M as copper ion, a complexing agent for copper ion in an amount of 0.8 time or more the mole concentration of copper ion, a reducing agent in an amount of 0.02M to 0.5M, a pH adjustor bringing the pH of the solution within a range of 11.5 to 13.0, an accelerator of a monoamine in an amount of 0.01M or more, a temperature of the solution being 30° C. to 80° C., and wherein monoamine is selected from the group consisting of triethylamine, tripropylamine, tribenzylamine, N-methylpiperidine, tris(4-bromophenyl)amine, N-methylmorpholine, and a mixture thereof, whereby the solution allows a rate of deposition of copper of more than 10 μm/Hr.

12. A solution according to claim 11, wherein the rate of deposition of copper is 25 μm/Hr or more.

13. A solution according to claim 12, wherein the rate of deposition of copper is 30 μm/Hr or more.

14. A solution according to claim 12, wherein the amount of the copper salt is 0.03M to 0.06M as copper ion, the amount of the reducing agent is 0.03M to 0.2M, the pH is 12.0 to 12.8, the amount of the accelerator is 0.01M to 0.3M and the temperature of the solution is 50° C. to 70° C.

* * * * *